US006213892B1

(12) United States Patent
Felker et al.

(10) Patent No.: US 6,213,892 B1
(45) Date of Patent: Apr. 10, 2001

(54) MULTI-LAYER GOLF BALL

(75) Inventors: David L. Felker, Bonsall; Pijush K. Dewanjee, Oceanside, both of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/361,695

(22) Filed: Jul. 27, 1999

(51) Int. Cl.[7] ..... A63B 37/08
(52) U.S. Cl. ..... 473/370; 473/374
(58) Field of Search ..... 473/373, 374, 473/376, 367, 368, 370, 371

(56) References Cited

U.S. PATENT DOCUMENTS

| | | | | |
|---|---|---|---|---|
| 3,034,791 | | 5/1962 | Gallagher . | |
| 4,123,061 | | 10/1978 | Dusbiber . | |
| 4,248,432 | | 2/1981 | Hewitt et al. . | |
| 4,431,193 | * | 2/1984 | Nesbitt | 473/373 |
| 4,442,282 | | 4/1984 | Kolycheck . | |
| 4,848,770 | * | 7/1989 | Shama | 473/373 |
| 5,047,495 | | 9/1991 | Kolycheck . | |
| 5,066,762 | | 11/1991 | Ohbuchi et al. . | |
| 5,159,053 | | 10/1992 | Kolycheck et al. . | |
| 5,334,673 | | 8/1994 | Wu . | |
| 5,688,191 | * | 11/1997 | Cavallaro et al. | 473/373 |
| 5,803,831 | | 9/1998 | Sullivan et al. . | |

* cited by examiner

*Primary Examiner*—Mark S. Graham
*Assistant Examiner*—Raeann Gorden
(74) *Attorney, Agent, or Firm*—Michael A. Catania

(57) ABSTRACT

A multiple layer golf ball having a high compression core and a soft boundary layer is disclosed herein. The multiple layer golf ball may also have a hard cover. The soft boundary layer allows the multiple layer golf ball to mimic the properties of a lower compression core while providing good distance. The multiple layer golf ball has a low driver spin and a high pitching wedge spin. The boundary layer is composed of a polyurethane formed from a PPDI-based prepolymer while the core is composed of a polybutadiene. The cover may be composed of an ionomer blend.

18 Claims, 1 Drawing Sheet

MULTI-LAYER GOLF BALL

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates generally to golf balls, and golf ball mantle layer and cover materials. More particularly, the present invention relates to multi-layer golf balls having mantle layer materials composed of cast urethanes and cover materials composed of injection moldable materials.

2. Description of the Related Art

Conventionally golf balls are made by molding a cover around a core. The core may be wound or solid. A wound core typically comprises elastic thread wound about a solid or liquid center. Unlike wound cores, solid cores do not include a wound elastic thread layer. Solid cores typically may comprise a single solid piece center or a solid center covered by one or more mantle or boundary layers of material.

Materials previously used as golf ball covers include balata (natural or synthetic), gutta-percha (natural), and ionomeric resins (e.g., DuPont's Surlyn®).

Balata is, typically, the benchmark cover material with respect to click (i.e., the sound made when the ball is hit by a golf club) and feel (i.e., the sensation imparted to the golfer when hitting the ball). Upon impact, the soft and flexible balata covers compress against the surface of the golf club, producing a good "click and feel." Consequently, experienced golfers are able to apply a spin to control balata covered golf balls in flight in order to produce a draw or a fade, or a backspin which causes the ball to "bite" or stop abruptly on contact with the green. Although balata provides golf balls with good playability properties, it is expensive compared to alternative materials. In addition, golf balls covered with balata tend to have poor durability (i.e. poor cut and shear resistance). Balata covered Golf balls, therefore, tend to have a relatively short life span.

As compared to balata, ionomeric resins are typically less expensive and tend to have good durability, but typically have poor click and feel. This is because although the ionomeric resins are very durable, they tend to be very hard when used for golf ball cover construction. In addition, because ionomeric resins are harder than balata, the ionomeric resin covers do not compress as much against the golf club upon impact, thus producing less spin. The "hard" ionomeric resins, however, provide golf balls with good distance.

Therefore, a great deal of research continues in order to develop a golf ball cover composition exhibiting not only the improved impact resistance and carrying distance properties produced by the "hard" ionomeric resins, but also the playability (i.e., "spin," "click and feel," etc.) characteristics previously associated with the "soft" balata covers, properties which are still desired by the more skilled golfer.

Particularly, polyurethanes have been proposed as golf ball cover materials. Polyurethanes are the result of crosslinking a prepolymer by reacting it with a polyfunctional curing agent, such as a polyamine or a polyol. A prepolymer is the reaction product of, for example, a diisocyanate and a polyol (e.g., a polyether or a polyester).

Some polyurethanes are thermoset, i.e., a substantially irreversibly set polymer, and others are thermoplastic, i.e., recyclable. Several patents describe the use of polyurethanes in golf balls.

Gallagher, U.S. Pat. No. 3,034,791 describes a polyurethane comprising the reaction product of poly (tetramethylene ether) glycol and 2,4-toluene-diisocyanates (TDI) (either pure or an isomeric mixture).

Dusbiber, U.S. Pat. No. 4,123,061 describes a polyurethane comprising the reaction product of a polyether (i.e., polyalkylene ether glycol, e.g., polytetramethylene ether glycol) and a diisocyanate (e.g., 2,4-toluene diisocyanate (TDI), 4,4'-diphenylmethane diisocyanate (MDI), and 3,3'-dimethyl-4,4'-biphenylene diisocyanate (TODI)) and a curing agent having at least two reactive amine groups (e.g., triisopropanol amine and trimethylol propane).

Hewitt, et al., U.S. Pat. No. 4,248,432 describes a thermoplastic polyesterurethane as a reaction product of a polyester glycol (molecular weight of 800–1500) (aliphatic diol and an aliphatic dicarboxylic acid) with paraphenylene diisocyanate (PPDI).

Kolycheck, U.S. Pat. No. 4,442,282 describes a thermoplastic polyesterurethane made by reacting a 1,12-dodecandioc acid polyester (molecular weight of about 1500–5000) with MDI.

Wu, U.S. Pat. No. 5,334,673 describes using a polyurethane prepolymer cured with a slow-reacting curing agent selected from slow-reacting polyamine curing agents and difunctional glycols.

Furthermore, two patents specifically describe multi-layer golf balls having a mantle layer which may comprise polyurethane material.

Cavallaro, U.S. Pat. No. 5,688,191 describes a multi-layer golf ball which has a mantle layer composed of a dynamically vulcanized thermoplastic elastomer, functionalized styrene-butadiene elastomer, thermoplastic polyurethane or metallocene polymer or blends thereof. Preferably, the mantle layer comprises a thermoplastic polyurethane. Further, Cavallaro discloses that the mantle layer is compression or injection molded over the core, and must withstand the temperatures applied during the application of the cover layer.

Similarly, Sullivan, U.S. Pat. No. 5,803,831 describes a multi-layer golf ball which, in an alternative embodiment, includes an inner cover having a greater shore D than the outer cover which may optionally comprise thermoplastic polyurethane, such as various Estane® products available from B. F. Goodrich.

In addition, several patents describe forming polyurethanes using PPDI.

Kolycheck, U.S. Pat. No. 5,159,053 describes a thermoplastic polyurethane having electrostatic dissipative properties, an average molecular weight of about 60,000–500,000, and comprising a hydroxyl terminated ethylene ether oligomer glycol intermediate (i.e. a polyethylene glycol) reacted with a non-hindered diisocyanate (e.g. PPDI, MDI, NDI, XDI, CHDI) and an extender glycol to produce a high molecular weight thermoplastic polyurethane.

Ohbuchi, et al., U.S. Pat. No. 5,066,762 describes a thermoplastic polyurethane resin obtained by reacting a PPDI, hydroxyl terminate poly(hexamethylene carbonate)

polyol (molecular weight 850–5000) and a short chain polyol as an extending agent. Asserted improvements are in hydrolysis resistance, heat deterioration resistance, temperature dependency and compression set.

Kolycheck U.S. Pat. No. 5,047,495 describes a polyurethane reinforced fabric molded flexible fuel tank made of a high molecular weight thermoplastic polyurethane polymer binder (molecular weight 60,000–500,000) comprising the reaction product of an ethylene ether oligomer glycol intermediate (a hydroxyl terminated diethylene glycol aliphatic linear polyester, or a polyethylene glycol) and a non-hindered diisocyanate (PPDI, MDI, XDI, CHDI) and an extender. The material is said to exhibit good fuel resistance.

None of these polyurethanes have proven satisfactory for use in golf balls or, more particularly, as mantel layer materials for multi-layer golf balls. For example, prior multi-layer balls tend to have softer cover layers and, thus, not sufficiently abrasion resistant. Furthermore, thermoplastic polyurethanes with reinforced fabric, as possibly suggested by Kolycheck, should not be used in golf ball materials because such an addition would lower those physical properties of the thermoplastic which are desirable for golf balls.

BRIEF SUMMARY OF THE INVENTION

The present invention provides a multi-layer golf ball with a soft boundary layer and a relatively hard cover. The unique combination of the present invention provides a multi-layer golf ball having improved durability, increased travel distance, and enhanced click and feel over prior multi-layer golf balls. Specifically, the hard cover of the present invention provides a golf ball with an improved impact resistance and carrying distance, while the soft boundary layer provides enhanced click and feel. In addition, multi-layer golf balls of the present invention have a high compression core while maintaining a lower overall spin due to the soft boundary layer. Moreover, the hardness of the cover and boundary layers may be varied to optimize driver and pitching wedge spins.

One aspect of the present invention is a golf ball including a core and a thermoset polyurethane boundary layer. The core has a diameter in the range of 1.40 to 1.59 inches and a PGA compression in the range of 75 to 95 points. The thermoset polyurethane boundary layer encompassing the core. The boundary layer has a thickness in the range of 0.015 to 0.075 inches and a shore D hardness in the range of 35 to 55. The thermoset polyurethane boundary layer may be composed of a TDI-based polyurethane prepolymer and an amine curing agent, PPDI-based polyurethane prepolymer and a diol curing agent, a MDI-based polyurethane prepolymer and a curing agent that may be a diol, an amine or a blend, or a blend of a TDI-based polyurethane prepolymer and a PPDI-based polyurethane prepolymer cured with a amine and diol blend.

Another aspect of the present invention is a golf ball that includes a core, a cast-molded thermoset polyurethane boundary layer and a cover. The core has a diameter in the range of 1.48 to 1.59 inches and a PGA compression in the range of approximately 80 to approximately 95 points. The cast-molded thermoset polyurethane boundary layer encompasses the core. The boundary layer has a thickness in the range of 0.015 to 0.075 inches, and a shore D hardness in the range of 42 to 53. The cover encompasses the cast-molded thermoset polyurethane boundary layer. The cover has a shore D hardness greater than the shore D hardness of the boundary layer.

Yet another aspect of the present invention is a method for manufacturing a golf ball having a thermoset polyurethane boundary layer over a core. Generally, the method includes cast molding a polyurethane boundary layer over a core having a diameter in the range of 1.48 to 1.59. The polyurethane boundary layer is formed from reactants composed of a diisocyanate based polyurethane prepolymer and a curing agent. The method also includes molding a cover layer over the polyurethane boundary layer.

The method may also include heating the diisocyanate based polyurethane prepolymer to a predetermined temperature, heating the curing agent to a predetermined temperature, and then mixing both. The method may also include placing the core in a first half of a mold containing the mixture of diisocyanate based polyurethane prepolymer and the curing agent. Then curing the mixture of diisocyanate based polyurethane prepolymer and the curing agent for a predetermined time period. Then, mating the first half of the mold with a second half of the mold. The second half of the mold contains the mixture of diisocyanate based polyurethane prepolymer and the curing agent. Finally, pressing the first half of the mold and the second half of the mold together for a predetermined time period to create a core with a boundary layer thereon.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
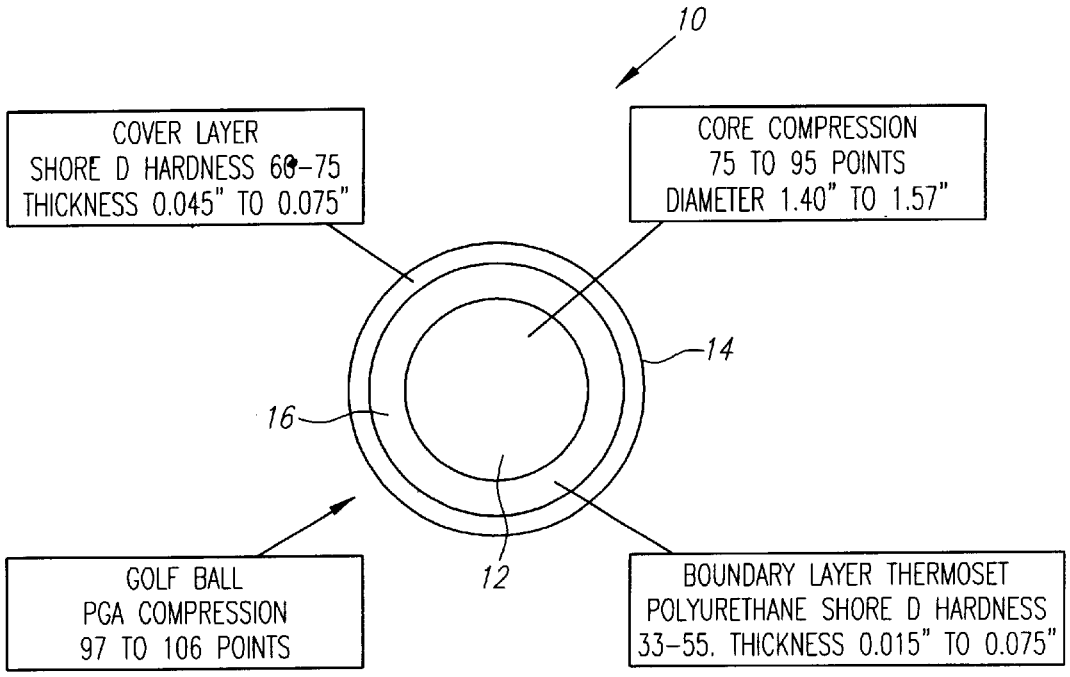
FIG. 1 illustrates a cross-sectional view of a golf ball 10 embodying the present invention illustrating a core 12, a boundary layer 14, and a cover 16.

As illustrated in FIG. 1, the present invention is directed at a golf ball 10 having a core 12, a cover 14 and at least one boundary layer 16 disposed between the core 12 and cover 14 in which the boundary layer 16 is composed of a thermoset polyurethane. The use of a thermoset polyurethane in the boundary layer 16 allows for the core 12 of the golf ball 10 to have a higher compression while the golf ball 10 as a whole has a lower overall spin. Thus, the golf ball 10 of the present invention is capable of mimicking the properties of a lower compression ball while providing a golf ball 10 with good distance.

The thermoset polyurethane boundary layer 16 encompasses the high compression core 12 and is itself encompassed by a cover 14 composed of a material having a shore D hardness greater than that of the boundary layer 16. The cover material may have a hardness between 60–75 shore D. The preferred cover material is an ionomer blend having a shore D hardness of 65. The shore D hardness of the boundary layer 16 is within the range of 33 to 55. This construction of the golf ball 10 in which a hard cover 14 encompasses a soft boundary layer 16 allows for the use of a high compression core 12 for distance while maintaining a lower overall spin for the golf ball 10. The hard cover 14 also increases the overall distance of the golf ball 10.

The thermoset polyurethane boundary layer 16 has a thickness in the range of 0.015 to 0.075 inches. The preferred thermoset or casted polyurethane system is composed of paraphenylene diisocyanate ("PPDI") prepolymer that is cured with a curing agent to create a thermoset polyurethane boundary 16 having a shore D hardness in the range of 42 to 53. The PPDI-based polyurethane prepolymer may be polycaprolactone terminated or polyester terminated. The PPDI-based polyurethane is cured with either a diol (e.g., 1,4 butane diol, trimethylpropanol, hydroquinone), a mixture of diols (e.g., 1,4 butane diol and ethylene glycol), a triol, a mixture of triols, a diamine, a mixture of diamines, an oligomeric diamine, or a blend of some or all of these materials. The PPDI-based polyurethane prepolymer preferably has a molecular weight in the range of about 650–2500. The preferred ratio of PPDI-based polyurethane prepolymer to curative is preferably within the range of 5:1 to 60:1, and more preferably in the range of about 7:1 to 45:1, and most preferably within the range of about 10:1 to 30:1. A preferred PPDI-based polyurethane prepolymer is ADIPRENE® from Uniroyal Chemical Company, Inc. Middlebury, Conn.

In addition to PPDI-based polyurethane prepolymers, other cast urethane systems may be used to produce the boundary layer 16 of the golf ball 10 of the present invention. Some examples of such systems are castable urethanes based on 4,4'-diphenylmethane diisocyanate ("MDI"), 2,4-toluene diisocyanate ("TDI"), 3,3'-dimethyl-4,4'-biphenylene diisocyanate ("TODI"), and the like. These polyurethane prepolymers may be used individually or blended together to form the boundary layer 16 of the golf ball 10 of the present invention. Whether composed of a single polyurethane prepolymer or a blend, the thermoset polyurethane boundary layer 16 has a shore D hardness in the range of 42 to 53, and always has a shore D hardness less than that of the cover layer 14.

The cover layer 14 is preferably composed of a thermoplastic (e.g. thermoplastic or thermoplastic elastomer) or a blend of thermoplastics (e.g. metal containing, non-metal containing or both) in order to provide the necessary hardness for distance purposes. Additionally, a cover layer composed of a hard material will contribute to the durability of the golf ball 10. The soft boundary layer 16 will compensate for the hard cover layer 14 thereby allowing for the golf ball 10 to have an overall soft feel and click similar to a balata covered golf ball.

Most preferably, the cover layer 14 is composed of at least one ionomer material that contains organic chain molecules and metal ions. The metal ion may be, for example, sodium, zinc, magnesium, lithium, potassium, cesium, or any polar metal ion that serves as a reversible cross-linking site and results in high levels of resilience and impact resistance. Suitable commercially available ionomers are based on ethylene copolymers and containing carboxylic acid groups with metal ions such as described above. The acid levels in such suitable ionomers may be neutralized to control resiliency, impact resistance and other like properties. In addition, other fillers with ionomer carriers may be used to modify (e.g. preferably increase) the specific gravity of the thermoplastic blend to control the moment of inertia and other like properties. Most preferably, the cover layer 14 is composed of a blend of ionomers such as SURLYN® available from DuPont and IOTEK® available from Exxon Chemical.

Alternatively, the cover layer 14 is composed of a similar thermoplastic material with a sufficiently high shore D hardness including but not limited to thermoplastic polyurethanes such as HYLENE® and thermoplastic polyesters such as HYTREL®, both available from DuPont. Yet further, the cover layer may be composed of a second thermoset polyurethane which has a shore D hardness greater than the shore D hardness of thermoset polyurethane of the boundary layer 16. The cover layer 14 has a thickness of 0.045 to 0.075 inches. Preferably, the cover layer 14 has a shore D hardness of 65 to 75.

As mentioned above, the preferred material for the cover layer 14 is a blend of ionomers. One preferred example is a blend of SURLYN® 8150 and SURLYN® 9150 that are, respectively, an ionomer resin composed of a sodium neutralized ethylene/methacrylic acid and an ionomer resin composed of a zinc neutralized ethylene/methacrylic acid. A preferred mixture has equal parts of SURLYN® 8150 and SURLYN® 9150, and the cover layer 14 for such a mixture has a shore D hardness of 65. Additionally, the mixture may contain a minimal amount of a baryte mixture such as 8 or 9 parts per hundred parts of the ionomer resins. One baryte mixture is composed of 80% barytes and 20% of an ionomer, and is available from Americhem, Inc., Cuyahoga Falls, Ohio, under the trade designation 38534X1.

The core 12 of the golf ball 10 is the "engine" for the golf ball 10 such that the inherent properties of the core 12 will strongly determine the initial velocity and distance of the golf ball 10. A higher initial velocity will usually result in a greater overall distance for a golf ball. In this regard, the Rules of Golf, approved by the United States Golf Association ("USGA") and The Royal and Ancient Golf Club of Saint Andrews, limits the initial velocity of a golf ball to 250 feet (76.2 m) per second (a two percent maximum tolerance allows for an initial velocity of 255 per second) and the overall distance to 280 yards (256 m) plus a six percent tolerance for a total distance of 296.8 yards (the six percent tolerance may be lowered to four percent). A complete description of the Rules of Golf are available on the USGA web page at www.usga.org. Thus, the initial velocity and overall distance of a golf ball must not exceed these limits in order to conform to the Rules of Golf. Therefore, the core 12 is constructed to enable the golf ball 10 to meet, yet not exceed, these limits.

Figure 2:
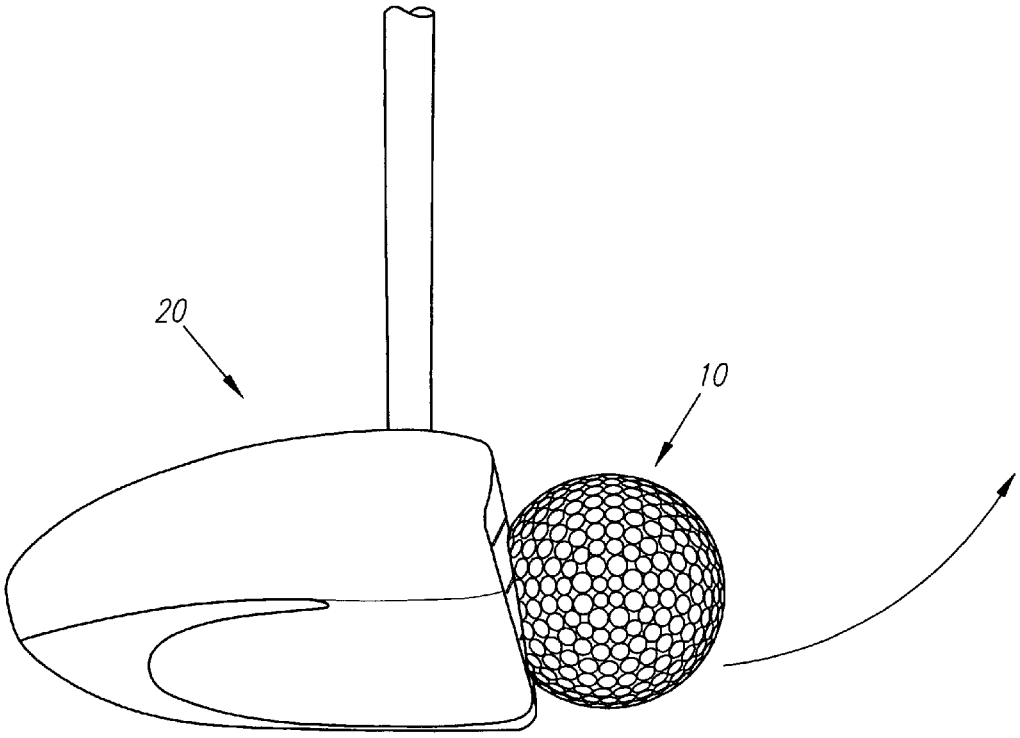
FIG. 2 illustrates a side view of a golf club impacting the golf ball of the present invention.

The coefficient of restitution ("COR") is a measure of the resilience of a golf ball. The COR is a measure of the ratio of the relative velocity of the golf ball after direct impact with a hard surface to the relative velocity before impact with the hard surface. The COR may vary from 0 to 1, with 1 equivalent to a completely elastic collision and 0 equivalent to a completely inelastic collision. A golf ball having a COR value closer to 1 will generally correspond to a golf ball having a higher initial velocity and a greater overall distance. The effect of a higher COR value is illustrated in FIG. 2 in which a golf club 20 strikes the golf ball 10. The force of the club 20 during a swing is transferred to the golf ball 10. If the golf ball has a high COR (more elastic), then the initial velocity of the golf ball will be greater than if the golf ball had a low COR. In general, a higher compression core will result in a higher COR value. Therefore, the golf ball 10 of the present invention has a core 12 with a high compression, and the COR value for the golf ball 10 ranges from 0.78 to 0.81.

The PGA compression of the core 12 is generally in the range of 75 to 100, and more specifically between 80 and 95. A preferred core PGA compression is 95. As used herein, the term "PGA compression" is defined as follows:

$$\text{PGA compression value} = 180 - \text{Riehle compression value}$$

The Riehle compression value is the amount of the deformation of the core in inches under a static load of 200 pounds multiplied by 1000. Accordingly, for a deformation of 0.095 inches under a load of 200 pounds, the Riehle compression is 95 and the PGA compression is 85.

The solid core 12 of the golf ball 10 is generally composed of a blend of a base rubber, a cross-linking agent, a free radical initiator, and one or more fillers or processing aids. A preferred base rubber is a polybutadiene having a cis-1,4 content of above about 90%, and more preferably 98% or above. Such materials are well known to those skilled in the art.

The use of cross-linking agents in a golf ball core is well known, and metal acrylate salts are examples of such cross-linking agents. For example, metal salt diacrylates, dimethacrylates, or mono(meth)acrylates are preferred for use in the golf ball cores of the present invention, and zinc diacrylate is a particularly preferred cross-linking agent. A commercially available suitable zinc diacrylate is SR-416 available from Sartomer Co., Inc., Exton, Pa. Other metal salt di- or mono-(meth)acrylates suitable for use in the present invention include those in which the metal is calcium or magnesium. In the manufacturing process it may be beneficial to pre-mix some cross-linking agent(s), such as, e.g., zinc diacrylate, with the polybutadiene in a master batch prior to blending with other core components.

Free radical initiators are used to promote cross-linking of the base rubber and the cross-linking agent. Suitable free radical initiators for use in the golf ball core 12 of the present invention include peroxides such as dicumyl peroxide, bis-(t-butyl peroxy) diisopropyl benzene, t-butyl perbenzoate, di-t-butyl peroxide, 2,5-dimethyl-2,5-di-5-butylperoxy-hexane, 1,1-di (t-butylperoxy) 3,3,5-trimethyl cyclohexane, and the like, all of which are readily commercially available.

Zinc oxide is also preferably included in the core formulation. Zinc oxide may primarily be used as a weight adjusting filler, and is also believed to participate in the cross-linking of the other components of the core (e.g. as a coagent). Additional processing aids such as dispersants and activators may optionally be included. In particular, zinc stearate may be added as a processing aid (e.g. as an activator). Any of a number of specific gravity adjusting fillers may be included to obtain a preferred total weight of the core 12. Examples of such fillers include tungsten and barium sulfate. All such processing aids and fillers are readily commercially available. A useful tungsten filler is WP102 Tungsten (having a 3 micron particle size) available from Atlantic Equipment Engineers (a division of Micron Metals, Inc.), Bergenfield, N.J.

Table 1 below provides the ranges of materials included in the preferred core formulations of the present invention.

TABLE 1

| | Core Formulations | |
|---|---|---|
| Component | Preferred Range | Most Preferred Range |
| Polybutadiene | 100 parts | 100 parts |
| Zinc diacrylate | 20–35 phr | 25–30 phr |
| Zinc oxide | 0–50 phr | 5–15 phr |
| Zinc stearate | 0–15 phr | 1–10 phr |
| Peroxide | 0.2–2.5 phr | 0.5–1.5 phr |
| Filler (e.g. tungsten) | As desired (e.g. 2–10 phr) | As desired (e.g. 2–10 phr) |

In the present invention, the core components are mixed and compression molded in a conventional manner known to those skilled in the art. In a preferred form, the finished core 12 has a diameter of about 1.49 to about 1.59 inches for a golf ball 10 having an outer diameter of 1.68 inches. The core weight is preferably maintained in the range of about 32 to about 40 g.

As mentioned above, the boundary layer 16 is preferably a thermoset polyurethane formed from a PPDI terminated polyester prepolymer or a PPDI terminated polyether prepolymer (molecular weight in the range of about 650–2500). Alternatively, the boundary layer 16 may be a polyurethane material formed from a blend of diisocyanates as disclosed in co-pending U.S. patent application Ser. No. 09/361,912, entitled Golf Ball With A Polyurethane Cover, filed on Jul. 27, 1999, pending, which is hereby incorporated by reference in its entirety.

For a thermoset polyurethane elastomer, the prepolymer is preferably cured with at least one of a diol type curative, such as, 1,4-butane diol, trimethylpropanol, hydroquinone, or a mixture of diols (such as 1,4-butane diol and ethylene glycol), a triol, or mixture of triols, or at least one of a diamine type curative(s), such as, methylenebis(orthochloroaniline) (i.e. ETHACURE™ 300 and ETHACURE™ 100 from Albemarle Corp., Baton Rouge La.) or an oligomeric diamine, or a mixture of some or all of these materials, and most preferably using a mixture of 1,4-butane diol and ethylene glycol. A more detailed explanation of the processing of a thermoset polyurethane layer is disclosed in co-pending U.S. patent application Ser. No. 09/296,197 entitled Golf Balls And Methods Of Manufacturing The Same, filed on Apr. 20, 1999, and in co-pending U.S. patent application Ser. No. 09/295,635, entitled Golf Ball With Polyurethane Cover, filed on Apr. 20, 1999, which are both hereby incorporated by reference in their entirety.

Typically, curing is accomplished by heating and mixing the prepolymer with the curative and then curing the mixture by applying heat and pressure. In addition, a catalyst (e.g. a tertiary amine) may be added to accelerate the process. The ratio of prepolymer to curative is preferably in the range of about 10:1 to about 30:1.

The prepolymer material is preferably degassed and warmed prior to processing. The processing temperature for the prepolymer is preferably in the range of about 100 to 220 degrees F., and most preferably in the range of about 120 to 200 degrees F. The prepolymer is preferably flowable in the range of about 200–1100 grams of material per minute or as needed for processing. In addition, the prepolymer material is preferably properly agitated, in the range of 0–250 rpm, to help maintain a more evenly distributed mixture of material and help eliminate crystallization.

The curative material is preferably a mixture of diols, such as, 1,4 butane diol and ethylene glycol. The curative material is also preferably degassed and warmed prior to processing. The processing temperature for the curative material is preferably in the range of about 50 to 230 degrees F., and most preferably in the range of about 80 to 200 degrees F. The curative is preferably flowable in the range of about 15–75 grams of material per minute or as needed. In addition, the curative material is preferably agitated, in the range of about 0 to 250 rpm, to help maintain even mixture of catalyst in the curative material.

The prepolymer and curative materials are preferably added to a common mixing chamber at a temperature in the range of about 120–220° F. Additives, such as, for example, polymer fillers, metallic fillers, and/or organic and inorganic fillers (e.g. polymers, balata, ionomers, etc.) may be added as well. The entire mixture is preferably agitated in the range of about 0 to 250 rpm prior to molding.

The boundary layer 16 is preferably casted about the core 12 in a conventional manner, to result in an overall core 12 and boundary layer 16 combination. See, e.g., U.S. Pat. No. 3,112,512, which is hereby incorporated by reference in its entirety. The cover layer 14 is preferably injection molded about the boundary layer 16 and core 12 combination. The afore-mentioned Rules of Golf require a golf ball to have a diameter of at least 1.68 inches. If the desired diameter of the golf ball 10 is about 1.68 inches, the core 12 preferably has a diameter in the range of about 1.40 to 1.56 inches, the boundary layer 16 preferably has a wall thickness in the range of about 0.015 to 0.075 inches, and the cover layer 14 preferably has a wall thickness in the range of about 0.045 to 0.075 inches.

This preferred embodiment configuration enables use of a boundary layer 16 which is preferably soft and flexible relative to the cover layer 14 to give a resultant golf ball 10 a better feel as compared to conventional balls. In addition, use of a thermoset polyurethane boundary layer 16 enables manipulation of specific gravities of the various layers to maximize the moment of inertia of the golf ball 10. The manipulation of specific gravities will lower the spin rate of the golf ball 10 to provide optimized straightness, flatness, and length of driven golf ball 10. Moreover, the hardness of the cover layer 14 and boundary layer 16 may be varied to optimize driver and pitching wedge spins.

It is preferred that the golf ball 10 exhibit a specific gravity of between 1.02 and 2.0, and more preferred between about 1.4–1.8, and most preferred between about 1.5–1.7. It is further preferred that the core 12 of the present invention exhibit a specific gravity of between about 1–1.2. It is also preferred that the thermoset polyurethane boundary layer 16 exhibit a specific gravity of between about 0.9–1.5. It is additionally preferred that the cover layer 14 exhibit a specific gravity of between about 1–1.3, and a flexural modulus of between about 14,000–80,000.

Table Two contains information for golf balls of the present invention.

TABLE TWO

| Ball | Core Compression | Core Diameter | Boundary Layer Hardness | Cover Layer Hardness | Core Spec. Gravity. |
|---|---|---|---|---|---|
| 1 | 80 | 1.49 | 53 | 65 | 1.13 |
| 2 | 80 | 1.49 | 42 | 65 | 1.13 |
| 3 | 95 | 1.49 | 53 | 65 | 1.10 |
| 4 | 95 | 1.49 | 42 | 65 | 1.10 |
| 5 | 80 | 1.54 | 53 | 65 | 1.13 |
| 6 | 80 | 1.54 | 42 | 65 | 1.13 |
| 7 | 95 | 1.54 | 53 | 65 | 1.09 |
| 8 | 95 | 1.54 | 42 | 65 | 1.11 |
| 9 | | 1.55 | 53 | 65 | |

TABLE THREE

| Ball | Ball Weight | Ball Compression | Ball Hardness | COR |
|---|---|---|---|---|
| 1 | 44.55 | 102 | 71 | 0.7981 |
| 2 | 44.11 | 97 | 67 | 0.8013 |
| 3 | 44.24 | 104 | 70 | 0.7808 |
| 4 | 43.83 | 100 | 69 | 0.7906 |
| 5 | 44.84 | 102 | 69 | 0.8030 |
| 6 | 44.68 | 102 | 68 | 0.8028 |
| 7 | 44.43 | 106 | 71 | 0.7921 |
| 8 | 44.29 | 105 | 69 | 0.7935 |
| 9 | 45.09 | 107 | 70 | 0.7826 |

The golf balls, 1–9, of Tables Two and Three had a core formulation consistent with that described in Table One. The core 12 was mainly composed of a cis-1,4, polybutadiene. The core 12 also included a zinc diacrylate, or a blend of zinc diacrylates. Golf balls 1, 2, 5, and 6 contained a single zinc diacrylate in the core 12, in an amount of 31.8 parts per one hundred parts of the polybutadiene. Golf balls 3, 4, and 7–9 contained a blend of zinc diacrylates in the core 12, in an amount ranging from 26 to 33 parts per one hundred parts of the polybutadiene. Golf balls 1, 2, 5, and 6 contained zinc oxide in the core 12, in an amount of 10 to 13 parts per one hundred parts of the polybutadiene. Golf balls 3, 4, and 7–9 contained zinc oxide in the core 12, in an amount ranging from 3.0 to 4.0 parts per one hundred parts of the polybutadiene. Golf balls 1, 2, 5, and 6 contained zinc stearate in the core 12 in an amount of 4.2 parts per one hundred parts of the polybutadiene. Golf balls 3, 4, and 7–9 contained zinc stearate in the core 12 in an amount of 3.0 parts per one hundred parts of the polybutadiene. Golf balls 1, 2, 5, and 6 contained titanium dioxide in the core 12 in an amount ranging from 1.5 to 3.5 parts per one hundred parts of the polybutadiene. Golf balls 3, 4, and 7–9 contained titanium dioxide in the core 12 in an amount of 1.0 part per one hundred parts of the polybutadiene. All of the golf balls contained trigonox 29/40 (a peroxide) in the core 12, in an amount ranging from 0.7 to 0.8 parts per one hundred parts of the polybutradiene. Golf balls 3, 4, and 7–9 contained a clay filler in the core 12, in an amount ranging from 8.0 to 10.0 parts per one hundred parts of the polybutadiene. The Shore D hardness of the core 12 of all of the golf balls ranged from 42 to 51.9. The rebound percentage of the core 12 of all of the golf balls ranged from 80.4% to 83.8%.

The cover layer 14 of all of the golf balls of Tables Two and Three were composed of an ionomer blend of equal parts of SURLYN® 8150 AND SURLYN® 9150. The boundary layer 16 of each of the golf balls of Tables Two and Three were composed of a cast molded (thermoset) PPDI-based polyurethane prepolymer cured with a 1,4-butane diol and ethylene glycol mixture. The prepolymer is either PPDI terminated polycaprolactone prepolymer or PPDI terminated polyester prepolymer. The golf balls of Tables Two and Three have a boundary layer shore D hardness of 53 and 42. The 53 shore D hardness PPDI polyurethane prepolymer is available from Uniroyal under the tradename LFPX 950. The 42 shore D hardness PPDI polyurethane prepolymer is available from Uniroyal under the tradename LFPX 850. The thickness of the boundary layer 16 is 0.020 inches for the 53 shore D hardness polyurethane, and 0.045 inches for the 42 shore D polyurethane.

The golf balls 1–9 were tested against the Maxfli REVOLUTION®, the Bridgestone PRECEPT EV®, the Titleist PROFESSIONAL®, the Titleist TOUR BALATA®, and the Titleist DT 2 piece®. The test were conducted at an indoor testing range using a robot launcher. Table Four illustrates the results for a driver at 90 mph, and Table Five illustrates the results for a pitching wedge at 76 mph. It is apparent from Table Four that the golf balls of the present invention have a greater ball speed and a greater distance than some of the most popular golf balls are available at the present time. Further, it is apparent from Table Five that the golf balls of the present invention have a slower spin off a pitching wedge than some of the most popular golf balls are available at the present time.

TABLE FOUR

| Ball | Ball Speed (mph) | True Spin (rpm) | Carry (yds) | Total Distance (yds) |
|---|---|---|---|---|
| Revolution | 131.97 | 2928 | 197.6 | 219.1 |
| Precept EV | 132.81 | 2746 | 200.1 | 219.1 |
| Professional | 131.62 | 2884 | 196.9 | 218.5 |

TABLE FOUR-continued

| Ball | Ball Speed (mph) | True Spin (rpm) | Carry (yds) | Total Distance (yds) |
|---|---|---|---|---|
| Tour Balata | 131.46 | 3172 | 196.1 | 214.6 |
| DT 2-piece | 133.97 | 2677 | 202.8 | 225.7 |
| 1 | 134.69 | 2782 | 205.2 | 225.9 |
| 2 | 135.05 | 2816 | 205.2 | 225.8 |
| 3 | 133.98 | 2973 | 202.3 | 221.6 |
| 4 | 134.61 | 2842 | 203.9 | 224.3 |
| 5 | 134.89 | 2845 | 205.6 | 225.8 |
| 6 | 135.07 | 2778 | 206.0 | 226.9 |
| 7 | 134.39 | 2816 | 203.9 | 224.7 |
| 8 | 134.67 | 2799 | 204.7 | 225.4 |
| 9 | 133.31 | 2743 | 200.5 | 223.5 |

TABLE FIVE

| Ball | Ball Speed (mph) | True Spin (rpm) | Launch Angle |
|---|---|---|---|
| Revolution | 97.13 | 8995 | 24.16 |
| Precept EV | 97.28 | 8801 | 24.78 |
| Professional | 95.94 | 8380 | 25.41 |
| Tour Balata | 96.74 | 9102 | 24.53 |
| DT 2-piece | 97.62 | 7428 | 26.63 |
| 1 | 95.59 | 6019 | 28.76 |
| 2 | 95.98 | 6365 | 28.43 |
| 3 | 95.03 | 6309 | 28.31 |
| 4 | 95.74 | 6486 | 28.26 |
| 5 | 95.79 | 6370 | 28.33 |
| 6 | 95.96 | 6534 | 28.10 |
| 7 | 95.56 | 6471 | 28.14 |
| 8 | 95.55 | 6466 | 28.27 |
| 9 | 97.07 | 6993 | 27.09 |

While embodiments of the present invention have been shown and described, various modifications may be made without departing from the scope of the present invention, and all such modifications and equivalents are intended to be covered. For example, the size and thickness ranges given are primarily directed to a ball having a finished diameter of about 1.68 inches. However, balls of different sizes are considered to be covered by the present invention. From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf ball comprising:

a core having a diameter in the range of 1.40 to 1.59 inches and a PGA compression in the range of 60 to 95 points;

a thermoset polyurethane boundary layer encompassing the core, the boundary layer having a thickness in the range of 0.015 to 0.075 inches and a shore D hardness in the range of 33 to 55, the thermoset polyurethane boundary layer comprising a polyurethane material formed from a reaction of a p-phenylene diisocyanate based polyurethane prepolymer and at least one reactant selected from the group consisting of a chain extender, a cross-linking agent, a curative and mixtures thereof, and a cover encompassing the thermoset boundary layer.

2. A golf ball comprising:

a core having a diameter in the range of 1.40 to 1.59 inches and a PGA compression in the range of 60 to 95 points;

a thermoset polyurethane boundary layer encompassing the core, the boundary layer having a thickness in the range of 0.015 to 0.075 inches and a shore D hardness in the range of 33 to 55, the thermoset polyurethane boundary layer comprising a polyurethane material formed from a reaction of a p-phenylene diisocyanate based polyurethane prepolymer, a toluene diisocyanate based polyurethane prepolymer, and at least one reactant selected from the group consisting of a chain extender, a cross-linking agent, a curative and mixtures thereof.

3. The golf ball according to claim 1 wherein the core has a diameter of approximately 1.54 to 1.58 inches.

4. The golf ball according to claim 1 wherein the golf ball has a PGA compression of 97 to 106 points.

5. The golf ball according to claim 3 wherein the core has a PGA compression of 80 to 95.

6. The golf ball according to claim 2 further comprising a cover encompassing the thermoset polyurethane boundary layer, the cover comprising an ionomer material.

7. The golf ball according to claim 2 further comprising a cover encompassing the thermoset polyurethane boundary layer, the cover comprising an thermoset polyurethane material.

8. The golf ball according to claim 6 wherein the cover has a thickness of 0.045 to 0.075 inches.

9. A golf ball comprising:

a core having a diameter in the range of 1.48 to 1.59 inches and a PGA compression in the range of approximately 80 to approximately 95 points;

a cast-molded thermoset polyurethane boundary layer encompassing the core, the boundary layer having a thickness in the range of 0.015 to 0.075 inches and a shore D hardness in the range of 33 to 55, the cast molded thermoset polyurethane boundary layer comprising a polyurethane material formed from a p-phenylene diisocyanate based polyurethane prepolymer and reacted with at least one reactant selected from the group consisting of a chain extender, a cross-linking agent, a curative and mixtures thereof; and a cover encompassing the cast-molded thermoset polyurethane boundary layer, the cover having a shore D hardness greater than the shore D hardness of the boundary layer.

10. The golf ball according to claim 9 wherein the golf ball has a PGA compression between 97 and 106.

11. A golf ball comprising:

a core having a diameter in the range of 1.48 to 1.59 inches and a PGA compression in the range of approximately 80 to approximately 95 points;

a cast-molded thermoset polyurethane boundary layer encompassing the core, the boundary layer having a thickness in the range of 0.015 to 0.075 inches and a shore D hardness in the range of 33 to 55, the cast molded thermoset polyurethane boundary layer comprising a polyurethane material formed from a 4,4'-diphenylmethane diisocyanate based polyurethane prepolymer and reacted with at least one reactant selected from the group consisting of a chain extender, a cross-linking agent, a curative and mixtures thereof; and a cover encompassing the cast-molded thermoset polyurethane boundary layer, the cover having a shore D hardness greater than the shore D hardness of the boundary layer.

12. The golf ball according to claim 10 wherein the cover comprises an ionomer material.

13. The golf ball according to claim 10 wherein the cover comprises a thermoset polyurethane material.

14. A method for manufacturing a golf ball, the method comprising:

cast molding a polyurethane boundary layer over a core having a diameter in the range of 1.48 to 1.59, the polyurethane boundary layer formed from reactants comprising a diisocyanate based polyurethane prepolymer and a curing agent; and molding a cover layer over the polyurethane boundary layer.

15. The method according to claim 14 further comprising:

heating the diisocyanate based polyurethane prepolymer to a predetermined temperature;

heating the curing agent to a predetermined temperature;

mixing the diisocyanate based polyurethane prepolymer with the agent to form a common mixture prior to cast molding the boundary layer over the core.

16. The method according to claim 15 further comprising:

placing the core in a first half of a mold containing the mixture of diisocyanate based polyurethane prepolymer and the curing agent;

curing the mixture of diisocyanate based polyurethane prepolymer and the curing agent for a predetermined time period;

mating the first half of the mold with a second half of the mold, the second half of the mold containing the mixture of diisocyanate based polyurethane prepolymer and the curing agent; and pressing the first half of the mold and the second half of the mold together for a predetermined time period to create a core with a boundary layer thereon.

17. The method according to claim 14 wherein the cover is injection molded over the boundary layer.

18. The method according to claim 17 wherein the cover is composed of an ionomer blend material having a shore D hardness greater than the shore D hardness of the boundary layer.

* * * * *